US007090956B2

(12) United States Patent
Suzuki et al.

(10) Patent No.: US 7,090,956 B2
(45) Date of Patent: Aug. 15, 2006

(54) IMAGE FORMING METHOD AND IMAGE FORMING APPARATUS

(75) Inventors: Katsuhiko Suzuki, Ibaraki (JP); Masami Ishikawa, Ibaraki (JP); Tsuneaki Kawanishi, Ibaraki (JP); Teruaki Mitsuya, Ibaraki (JP); Hisao Okada, Ibaraki (JP); Masayoshi Ishii, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 0 days.

(21) Appl. No.: 10/025,550

(22) Filed: Dec. 26, 2001

(65) Prior Publication Data

US 2002/0127488 A1 Sep. 12, 2002

(30) Foreign Application Priority Data

Mar. 9, 2001 (JP) ..... 2001-066085

(51) Int. Cl.
*G03G 13/09* (2006.01)

(52) U.S. Cl. ..... 430/122; 430/110.3; 430/124

(58) Field of Classification Search ..... 430/110.3, 430/122, 124; 399/269
See application file for complete search history.

(56) References Cited

U.S. PATENT DOCUMENTS 5,630,201 A * 5/1997 Suzuki et al. ..... 399/269
6,096,468 A * 8/2000 Ohno et al. ..... 430/108.3

FOREIGN PATENT DOCUMENTS

JP A-11-149186 6/1999

OTHER PUBLICATIONS

Neufeldt, V. et al. ed., *Webster's New World Dictionary*, Third College Edition, Simon & Schuster, Inc., NY (1988), p. 815.*
DERWENT English-language translation of JP 2000-267338 A (pub. 9-2000).*
Diamond, A.S., ed., *Handbook of Imaging Materials*, Marcel Dekker,Inc., NY (1991), pp. 160-161.*

* cited by examiner

*Primary Examiner*—Janis L. Dote
(74) *Attorney, Agent, or Firm*—McGinn IP Law Group, PLLC

(57) ABSTRACT

In an image forming method, when viewed from the moving direction of a photosensitive body 1, there is disposed, on the upstream side, a first developing roller 61 opposed to and adjacent to the photosensitive body 1 and rotatable in the opposite direction to the photosensitive body 1, while the peripheral speed ratio of the roller 61 to the photosensitive body 1 ranges from 0.8 to 2.0; on the downstream side of the roller 61, there is disposed a second developing roller 62 rotatable in the same direction to the photosensitive body 1, while the peripheral speed ratio of the roller 62 to the photosensitive body 1 ranges from 1.05 to 2.0; and the shape coefficient SF1 of the toners of two-component developing agent ranges from 120 to 170, while the shape coefficient SF2 ranges from 110 to 130.

10 Claims, 4 Drawing Sheets

FIG. 7

| | SF1 | SF2 | CHARGED ELECTRICITY AMOUNT | FOG | CLEANING PROPERTY | SPENT PHENOMENON |
|---|---|---|---|---|---|---|
| TEST 1 | 137.4 | 119.6 | ○ | ○ | ○ | ○ |
| TEST 2 | 143.6 | 120.2 | ○ | ○ | ○ | ○ |
| TEST 3 | 137.5 | 115.9 | ○ | ○ | ○ | ○ |
| TEST 4 | 141.8 | 118 | ○ | ○ | ○ | ○ |
| TEST 5 | 165.7 | 128 | △ | △ | ○ | ○ |
| TEST 6 | 156.2 | 125.2 | ○ | ○ | ○ | ○ |
| TEST 7 | 169.5 | 132.2 | × | × | ○ | × |
| TEST 8 | 110.5 | 114.3 | ○ | ○ | × | ○ |

IMAGE FORMING METHOD AND IMAGE FORMING APPARATUS

BACKGROUND OF THE INVENTION

1. Field of the Invention

The present invention relates to an image forming method and an image forming apparatus for forming a large number of images repetitively in an electrophotographic method and an electrostatic recording method and, in particular, to such image forming method and apparatus for developing an electrostatic latent image formed on an image carrier using a two-component magnetic developing agent consisting mainly of magnetic carriers and toners.

2. Description of the Related Art

In conventional electrophotographic method and electrostatic recording method, the entire area of the surface of a photoconductive photosensitive body is charged uniformly and is then exposed to thereby form an electrostatic latent image on the photosensitive body. After then, the electrostatic latent image is developed by a developing apparatus including a developing roller rotatable and having power of magnetic suction according to a two-component developing method for developing an electrostatic latent image using toners including coloring agents and magnetic carriers. In this development, the toners including coloring agents, due to the rotation of the developing roller, are rubbed against the magnetic carriers to be thereby electrically charged with desired values. The developed toner image is transferred onto a recording medium such as a recording sheet. The toner image on the recording medium is fixed to thereby form a recorded image. On the other hand, the remaining toners, which are not transferred onto the recording medium but are left on the photosensitive body, are cleaned by a cleaner. The above process is repeated for a long period of time. The image forming technology using the two-component developing method is proposed, for example, in Japanese Patent No. 3008838 and JP-B-6-29979.

Now, description will be given below in more detail of a developing system in which development is carried out while supplying toners to a photosensitive body 1. Firstly, description will be given of a forward-rotation developing system according to the prior art with reference to FIG. 2. A developing roller 61, which can be rotated in the same direction as the photosensitive body 1, includes a magnet 51 in the interior thereof; due to the magnetic suction power of the magnet 51, a two-component magnetic developing agent consisting mainly of toners and magnetic carriers is attracted to the developing roller 61, is then delivered due to the rotation of the developing roller 61 and is thus contacted with the photosensitive body 1, thereby developing an electrostatic latent image. The advantage of this developing system is as follows: that is, since, in the developing area where the photosensitive body and toners are contacted with each other and an electrostatic latent image is developed, the toners on the developing roller moves in the opposite direction to the moving direction of the photosensitive body, the force for the toners to rub against the surface of the photosensitive body increases and thus the cleaning effect in cleaning the surface of the photosensitive body can be enhanced. Also, because the developing roller moves in the opposite direction to the moving direction of the photosensitive body, a speed difference between the photosensitive body and developing roller is increased; and, therefore, even in case where the number of rotations of the developing roller is set small, there can be realized a high image density. However, the present developing system has a disadvantage that, since the contact between the photosensitive body and toners is strong, the quality of the image formed can be put into disorder. Also, there arises another problem that the leading end of a gang black image portion can be chipped.

Next, description will be given below of a reverse-rotation developing system according to the prior art with reference to FIG. 3. A developing roller 61, which can be rotated in the opposite direction to the photosensitive body 1, includes a magnet 51 in the interior thereof; due to the magnetic suction power of the magnet 51, a two-component magnetic developing agent consisting mainly of toners and magnetic carriers is attracted to the developing roller 61, is then delivered due to the rotation of the developing roller 61 and is thus contacted with the photosensitive body 1, thereby developing an electrostatic latent image. The advantage of this developing system is as follows: that is, since, in the developing area where the photosensitive body and toners are contacted with each other and an electrostatic latent image is developed, the toners on the developing roller moves in the same direction as the moving direction of the photosensitive body, the force for the toners to rub against the surface of the photosensitive body decreases, so that the quality of the image formed cannot be degraded but a high image quality can be realized. However, the present reverse-rotation developing system also has a disadvantage that, since the force for the toners to rub against the surface of the photosensitive body is weak, the cleaning performance of the surface of the photosensitive body is poor. Also, because the developing roller moves in the same direction as the moving direction of the photosensitive body, the speed difference between the photosensitive body and developing roller is small; and, therefore, to realize a high image density, the number of rotations of the developing roller must be set large. Further, in the case of the image quality, there is a problem that the rear end of a gang black image can be chipped. This phenomenon occurs very often especially when the image density is low.

In order to solve the above problems, there is proposed a center feed developing system including two developing rollers 61, 62 which, as shown in FIG. 4, can be rotated in the mutually opposite directions. On the upstream side of the moving direction of the photosensitive body, in the developing area, there is disposed a first developing roller 61 which can be moved in the opposite direction to the moving direction of the photosensitive body; and, on the downstream side thereof, there is disposed a second developing roller 62 which can be moved in the same direction to the moving direction of the photosensitive body. That is, in the center feed developing system, since it is capable of both reverse-rotation development and forward-rotation development, the disadvantages of the respective developing systems can be compensated to thereby be able to obtain good image quality.

However, when either of the above-mentioned reverse-rotation or forward-rotation developing system including a developing roller is employed in high-speed printing, there arises the following problem: that is, the developing ability is scarce because of the increased rotation and, in order to compensate this, the number of rotations of the developing roller must be increased; and, therefore, there is caused a vicious circle that stresses to be given to the developing agent increase to thereby shorten the life of the developing agent and impair the stability of the quality of the image formed.

Also, the present inventors have conducted examination tests to check the center feed developing system for the performance thereof when it is employed in high-speed printing. According to our tests, we have found the following problems. That is, when compared with the developing system including a single roller, the center feed developing system is enhanced in the high developing performance and is able to reduce the number of rotations of the developing rollers. However, in the center feed developing system, the ratio between the peripheral speed of the first developing roller and the peripheral speed of the photosensitive body as well as the ratio between the peripheral speed of the second developing roller and the peripheral speed of the photosensitive body have great influences on the quality of the image formed. That is, in case where the respective peripheral speed ratios go below their optimum ranges, even in the case of the center feed developing system, the developing performance is lowered to thereby have an ill influence on the image quality. On the other hand, in case where the respective peripheral speed ratios exceed their optimum ranges, the developing performance can be enhanced but stresses applied to both of the toners and developing agent increase to thereby have an ill influence on the life of the developing agent and thus impair the stability of the image quality. As can be seen from this, even in the center feed developing system, in case where the respective peripheral speed ratios deviate from their optimum ranges, the image quality and the characteristic of the developing agent can be ill influenced.

Here, description will be given below in more detail of the case in which the respective peripheral speed ratios are set so as to exceed their optimum ranges. In the case of the center feed developing system, as shown in FIG. 4, between the first and second developing rollers, there is interposed a developing agent distributing member 8; and thus, the developing agent can be restrictively distributed to the respective developing rollers by the developing agent distributing member 8. In such restrictive distribution of the developing agent, however, large stresses are applied to both of the toners and developing agent. Due to this, there arise the following problems: that is, external additives added to the surfaces of the toners can be embedded into the toner surfaces, and the toner components can be fused (spent) to the surfaces of the carriers, with the result that the frictional electric charging between the toners and carriers can be insufficient, a sufficient amount of charged electricity cannot be obtained, the toners can be scattered, a photographic fog can increase, and the life of the developing agent can be lowered.

SUMMARY OF THE INVENTION

In view of the above-mentioned circumstances of the conventional image forming methods and apparatus, it is an object of the invention to provide improved image forming method and apparatus which are capable of forming an image having stable quality even in case where the above-mentioned conventional center feed developing system is employed in the high-speed printing.

In attaining the above object, according to a first aspect of the invention, there is provided an image forming method, comprising the steps of: developing an electrostatic latent image formed on an image carrier into a toner image using toners; transferring the toner image onto a recording medium; and, fixing the toner image transferred onto the recording medium to thereby form a recorded image on a recording sheet, wherein the latent image is developed by first and second developing rollers disposed along the moving direction of the image carrier and rotatable in the mutually opposite directions using a two-component magnetic developing agent consisting mainly of toners and magnetic carriers, and the toners are supplied to the latent image on the image carrier by the first and second developing rollers, characterized in that the moving direction of the first developing roller is opposite to the moving direction of the image carrier in a developing area, and a peripheral speed ratio (S1=Vm1/Vp) between the peripheral speed (Vm1) of the first developing roller and the peripheral speed (Vp) of the image carrier is set in the range of 0.8–2.0; the moving direction of the second developing roller is the same as the moving direction of the image carrier in a developing area, and a peripheral speed ratio (S2=Vm2/Vp) between the peripheral speed (Vm2) of the second developing roller and the peripheral speed (Vp) of the image carrier is set in the range of 1.05–2.0; and, in case where the shape coefficients SF1, SF2 of the toners of the two-component magnetic developing agent consisting mainly of toners and magnetic carriers are defined according to following expressions (1) and (2), $$SF1=(\text{maximum length of diameter})^2/(\text{area of toner particle})\times\pi/4\times100 \quad (1)$$

$$SF2=(\text{peripheral length of projected image})^2/(\text{area of toner particle})\times100/4\pi \quad (2),$$

the shape coefficients SF1, SF2 can respectively satisfy the following conditions:

$$120\leqq SF1\leqq170$$

$$110\leqq SF2\leqq130.$$

According to a second aspect of the invention, there is provided an image forming method, comprising the steps of: developing an electrostatic latent image formed on an image carrier into a toner image using toners; transferring the toner image onto a recording medium; and, fixing the toner image transferred onto the recording medium to thereby form a recorded image on a recording sheet, wherein the latent image is developed by at one or more sets of first and second developing rollers disposed along the moving direction of the image carrier and rotatable in the mutually opposite directions using a two-component magnetic developing agent consisting mainly of toners and magnetic carriers, and the toners are supplied to said latent image on the image carrier by one or more sets of first and second developing rollers, characterized in that the moving direction of the first developing roller is opposite to the moving direction of the image carrier in a developing area, and a peripheral speed ratio (S1=Vm1/Vp) between the peripheral speed (Vm1) of the first developing roller and the peripheral speed (Vp) of the image carrier is set in the range of 0.8–2.0; the moving direction of the second developing roller is the same as the moving direction of the image carrier in a developing area, and a peripheral speed ratio (S2=Vm2/Vp) between the peripheral speed (Vm2) of the second developing roller and the peripheral speed (Vp) of the image carrier is set in the range of 1.05–2.0; and, in case where the shape coefficients SF1, SF2 of the toners of the two-component magnetic developing agent consisting mainly of toners and magnetic carriers are defined according to following expressions (1), (2), $$SF1=(\text{maximum length of diameter})^2/(\text{area of toner particle})\times\pi/4\times100 \quad (1)$$

$$SF2=(\text{peripheral length of projected image})^2/(\text{area of toner particle})\times100/4\pi \quad (2),$$

the shape coefficients SF1, SF2 can respectively satisfy the following conditions:

$120 \leqq SF1 \leqq 170$ $110 \leqq SF2 \leqq 130$.

BRIEF DESCRIPTION OF THE DRAWINGS

FIG. 7 is a characteristic view of the evaluation results obtained when the respective characteristics are evaluated while varying the toner shape coefficients SF1, SF2 variously.

DETAILED DESCRIPTION OF THE PREFERRED EMBODIMENTS

Figure 1:
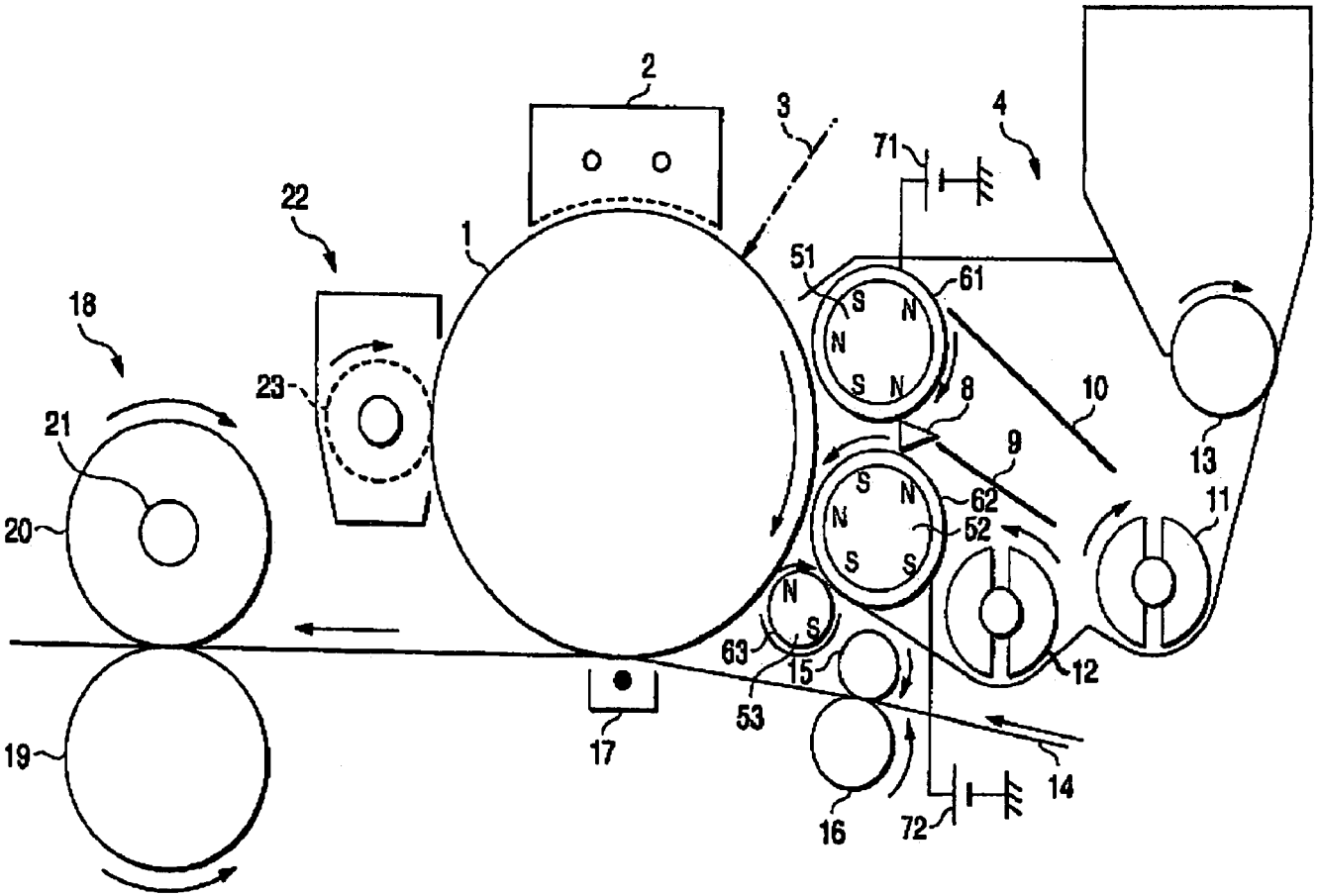
FIG. 1 is a typical view of an example of a printing apparatus of an electrophotographic type to which an image forming apparatus according to the invention is applied.
Figure 2:
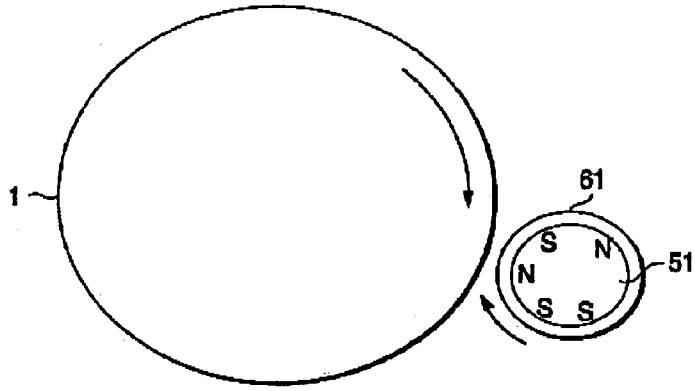
FIG. 2 PRIOR ART
FIG. 2 is a schematic section view of a first example of a conventional developing system.
Figure 3:
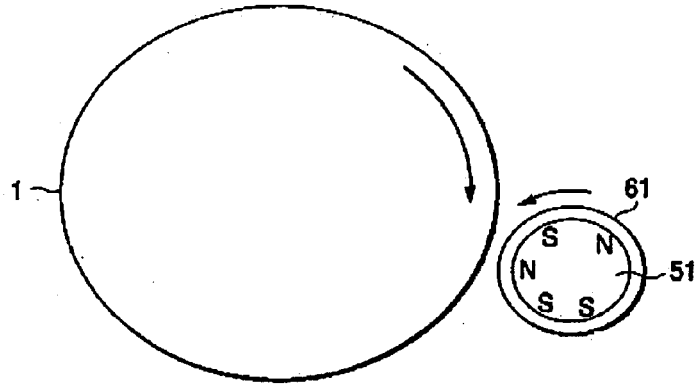
FIG. 3 PRIOR ART
FIG. 3 is a schematic section view of a second example of a conventional developing system.
Figure 4:
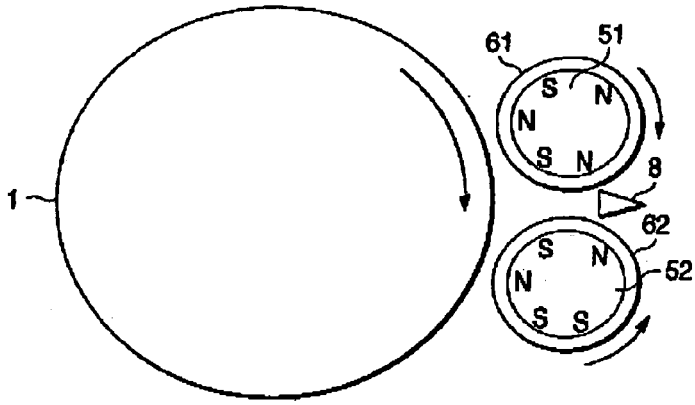
FIG. 4 PRIOR ART
FIG. 4 is a schematic section view of a third example of a conventional developing system.

Now, description will be given below of an embodiment of an image forming apparatus according to the invention with reference to the accompanying drawings. FIG. 1 is a typical view of an embodiment of an image forming apparatus according to the invention.

A photographic body 1 having a photoconductive characteristic is structured such that it can be rotated in a clockwise direction; and, in the periphery of the photographic body 1, there are disposed an electric charger 2, a laser beam 3, a developing device 4, a transfer device 17, and a cleaner 22.

After a photographic body 1 is charged uniformly by the electric charger 2, an electrostatic latent image is formed on the photographic body 1 using the laser beam 3. The charging polarity of the photographic body 1 may be positive or negative; and, in the present embodiment, it is assumed to be positive.

The photographic body 1 is charged with a voltage in the range of 400V–1000V, while the image portion of the photographic body 1 is exposed using the laser beam. The developing device 4 reverses and develops the electrostatic latent image to thereby form a toner image on the photographic body 1.

Next, description will be given below of the operation of the developing device 4. When viewed from the moving direction of the developing device 4, on the upstream side thereof, there is disposed a first developing roller 61 which is located opposed to and adjacent to the photographic body 1 and can be rotated in the same direction as the photographic body 1; on the downstream side thereof, there is disposed a second developing roller 62 which can be rotated in the opposite direction to the photographic body 1; and, on the further downstream side thereof, there is disposed a carrier catch roller 63. The developing rollers 61, 62 and carrier catch roller 63 respectively include, in the interior portions thereof, magnets 51, 52 and 53 which are respectively fixed. Due to the magnetic forces of these magnets 51, 52 and 53, a two-component developing agent consisting mainly of toners and magnetic carriers is attracted to the developing rollers 61, 62 and is then delivered due to the rotational movements of the developing rollers 61, 62 to thereby bring the developing agent into contact with the photographic body 1 and thus develop the electrostatic latent image formed on the photographic body 1.

The delivery quantity of the developing agent can be adjusted by a developing agent distributing member 8 and developing rollers 61, 62. Bias power source 71, 72 are connected to the developing rollers 61, 62, respectively; and, a voltage having the same polarity as the toners can be applied to the developing rollers 61, 62. By adjusting the bias power sources, the supply quantities of the toners from the developing rollers 61, 62 to the photographic body 1 can be adjusted.

Referring specifically to the developing agent within the developing device 4, the toners supplied from a toner feed roller 13 and the developing agent, which completes development on the first developing roller 61 and is then scraped off by a scraper 10, are combined together and are then supplied and delivered onto screw-shaped stirring members 11, 12 which are disposed in the lower portion of the developing device 4. Due to the rotational movements of the stirring members 11, 12, the combined developing agent is mixed and stirred back and forth as well as right and left and, while the supplied toners are electrically charged up to a given electric charging amount, the combined developing agent is returned back to the second developing roller 62. The developing agent is delivered on the surface of the second developing roller 62 due to the magnetic suction power of the magnet 52, and is restricted and distributed to the respective developing rollers 61, 62 by the developing agent distributing member 8. The surplus of the developing agent, which has been restricted by the second developing roller 62 and developing agent distributing member 8, is moved through a guide plate 9 and is returned back to the stirring members 11, 12 disposed in the lower portion of the developing device.

In some cases, besides the toners, the magnetic carriers can stick onto the photosensitive body 1. Such magnetic carriers on the photosensitive body 1 are collected using the carrier catch roller 63 including the magnet 53 and, due to the rotation of the carrier catch roller 63, the thus-collected carriers are returned to the interior of the developing device 4. The above-mentioned operations are carried out repeatedly.

Figure 5:
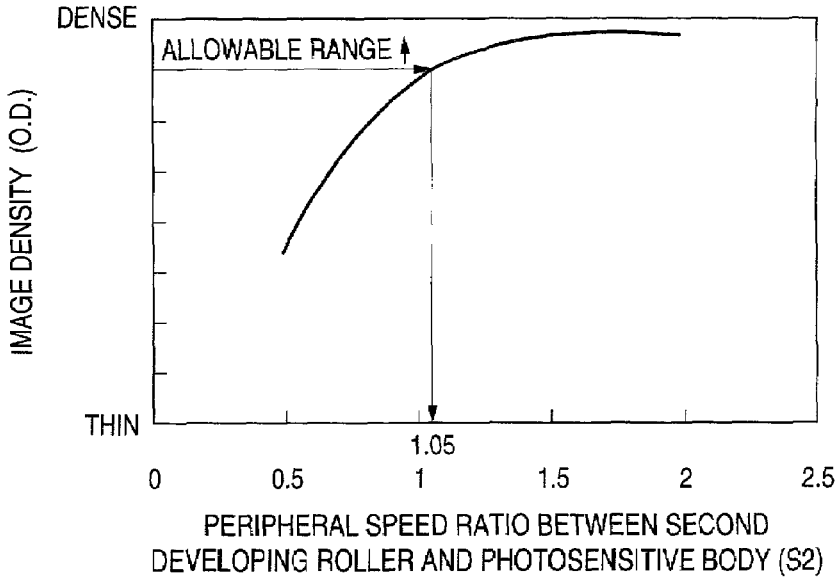
FIG. 5 is a graphical representation of the relationship between the image density and the peripheral speed ratio of the second developing roller to the photosensitive body.
Figure 6:
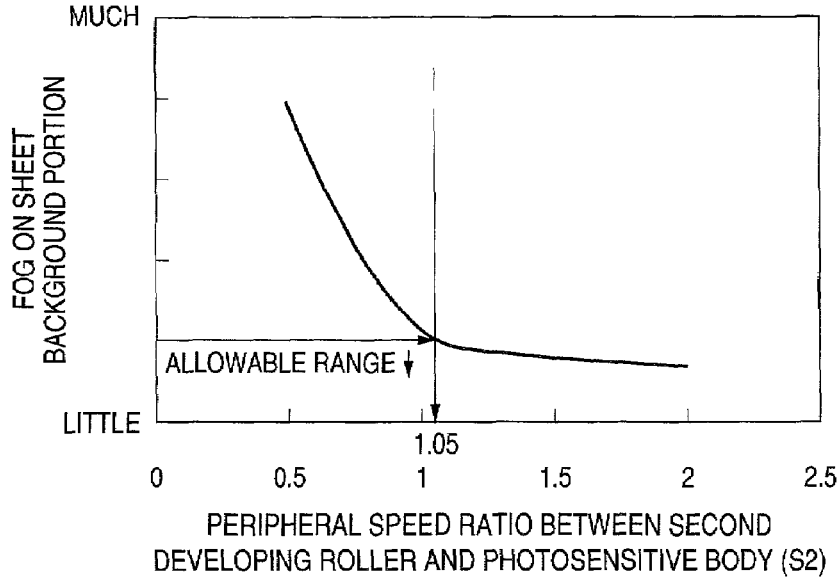
FIG. 6 is a graphical representation of the relationship between the photographic fog of the sheet background portion and the peripheral speed ratio of the second developing roller to the photosensitive body.

A recording sheet 14 is delivered by registration rollers 15, 16 and the toner image on the photosensitive body 1 is transferred to the recording sheet 14 by the transfer device 17. The recording sheet 14 with the toner image transferred thereto is heated and pressurized by a fixing device 18, so that the toner image is fixed. The fixing device 18 is composed of a heat roller 20 including a heater lamp 21 in the interior thereof and a backup roller 19. The toners remaining on the photosensitive body 1 after the toner image is transferred are removed by the cleaner 22. The cleaner 22 includes a fur brush 23 which can be rotated in contact with the photosensitive body Referring to the present embodiment, the present inventors have conducted performance tests as to the influences of the photosensitive body moving speed and developing roller moving speed on the image quality. Description will be given below of the results obtained by the tests. Here, a peripheral speed ratio S1 is a ratio of the peripheral speed Vd1 of the first developing roller 61 to the peripheral speed Vp of the photosensitive body 1, that is, S1=Vd1/Vp; and, a peripheral speed ratio S1 is a ratio of the peripheral speed Vd2 of the second developing roller 61 to the peripheral speed Vp of the photosensitive body 1, that is, S2=Vd2/Vp. In the tests, the gang black portion of the image was checked for the image density and the white portion of the image was checked for the photographic fog (the dirt of the sheet background portion). The test results are shown in FIGS. 5 and 6. By the way, the test conditions are as follows.

Photosensitive body 1 peripheral speed: 1800 mm/s

Photosensitive body 1 charged voltage: 900 V

First developing roller 61 bias voltage B1: 600 V

Second developing roller 62 bias voltage B1: 600 V

Peripheral speed ratio S1 between first developing roller 61 and photosensitive body 1: 1.3

Peripheral speed ratio S2 between second developing roller 62 and photosensitive body 1: 0.5–2

In our test, the image was printed under the above conditions and the gang black portion of the print image was checked for the image density thereof, and the white sheet portion of the printed image was checked for the photographic fog (fog in the sheet background portion) thereof. As can be seen from the evaluation or check results of the test, in case where the peripheral speed ratio S2 between the second developing roller 62 and photosensitive body 1 is equal to or larger than 1.05, the image density of the gang black portion and the photographic fog in the white sheet portion both fall within their respective allowable ranges to thereby be able to stabilize the image quality. In case where the peripheral speed ratio S2 is set equal to or larger than 2, the peripheral speed of the photosensitive body 1 is high and thus the number of rotations of the second developing roller 62 also deviates from the allowable range, which increases the damage of the toners and developing agent. For this reason, the upper limit value of the peripheral speed ratio S2 is set at 2.

In the above tests, the peripheral speed ratio S1 between first developing roller 61 and photosensitive body 1 was fixed to 1.3. However, in the case of the first developing roller 61, since the first developing roller 61 moves in the opposite direction to the moving direction of the photosensitive body 1 in the developing area, even in case where the peripheral speed ratio S1 between first developing roller 61 and photosensitive body 1 is set small, there can be obtained the same effect as the above tests, which has been proved from various experiments. And, in the present invention as well, even when the peripheral speed ratio S1 is lowered down to 0.8, the above effect was maintained. Referring to the upper limit value of the peripheral speed ratio S1, for the same reason as the above peripheral speed ratio S2, it is set at 2.

These evaluation results show that, in case where the peripheral speed ratio S1 between first developing roller 61 and photosensitive body 1 is set as $0.8 \leqq S1 \leqq 2.0$, preferably, $0.9 \leqq S1 \leqq 1.9$ and the peripheral speed ratio S2 between second developing roller 62 and photosensitive body 1 is set as $1.05 \leqq S2 \leqq 2.0$, preferably, $1.1 \leqq S2 \leqq 1.9$, the allowable image quality can be obtained.

The toner particles to be used in the invention are composed of coloring agents (black and other various colors) and connecting resin. As the toners to be used in the invention, there are available toners which are generally used, such as a styrene-acryl-system toner and a polyester-system toner. The average particle diameter of the toners may be in the range of 6–12 μm, preferably, in the range of 7–11 μm. However, in the case of the toners, in case where the shape coefficients SF1, SF2 of the toners are defined by the following expressions (1), (2):

$$SF1=(\text{maximum length of diameter})^2/(\text{area of toner particle})\times\pi/4\times100 \quad (1)$$

$$SF2=(\text{peripheral length of projected image})^2/(\text{area of toner particle})\times100/4\pi \quad (2),$$

the shape coefficients SF1, SF2 must be set so as to satisfy the following conditions:

$$120 \leqq SF1 \leqq 70$$

$$110 \leqq SF2 \leqq 130.$$

Referring in detail to the above-mentioned shape coefficients, they are used as coefficients which represent the form of toners such as the shape thereof. Such shape coefficients are defined according to a statistical technique, that is, an image analysis which is able to analyze quantatively the area, length and shape of an image caught by an optical microscope with high accuracy; and, the shape coefficients can be measured, for example, by an image analyzer [manufactured by Nileco. Co., Model Luzex IIIU] and an image professional [manufactured by Branetron Co.]. Specifically, the coefficient SF1 approaches 100 as the shape of a toner particle draws near to a circle; and, on the contrary, it increases in value as the shape of the toner particle becomes long and narrow. That is, SF1 expresses a difference between the maximum and minimum diameters of the toner, namely, the distortion of the toner. On the other hand, the coefficient SF2 approaches 100 as the shape of a toner particle draws near to a circle; and, it increases in value as the peripheral shape of the toner becomes complicated. That is, the coefficient SF2 represents the uneven state property of the surface area of the toner. In the case of a complete spherical shape, SF1=SF2=100.

The magnetic carriers that can be used in the invention include iron-powder-system carriers, ferrite-system carriers and magnetite-system carriers; and, the average particle diameter of the carriers may be set in the range of 50–150 μm, preferably, in the range of 70–110 μm.

Under the condition that the peripheral speed ratio S1 between first developing roller 61 and photosensitive body 1 is in the range of $0.8 \leqq S1 \leqq 2.0$ and the peripheral speed ratio S2 between second developing roller 62 and photosensitive body 1 is in the range of $1.05 \leqq S2 \leqq 2.0$, using several kinds of toners differing in the toner shape coefficients SF1, SF2, evaluation tests were conducted on the stability of the charged electricity amount, the occurrence of photographic fogs, the cleaning characteristic of the toner image formed, and the life of the developing agent. As can be understood from the test results shown in FIG. 7, in the case of the tests 1 to 6 in which the toner shape coefficients SF1, SF2 are in the above-mentioned ranges, there are obtained satisfactory effects in the respective test items. However, in case where the coefficient SF1 deviates from the above range, the stability of the charged electricity amount, the prevention of the occurrence of photographic fogs, the cleaning characteristic of the toner image formed, and the life of the developing agent are not sufficient. Also, in case where the coefficient SF2 deviates from the above range, similarly, there cannot be sufficient properties. Here, the test 7 shows a case where the coefficient SF2 deviates from the above range: specifically, since the peripheral shape of the toner particle is complicated and thus the surface of the toner is uneven in many portions thereof, the fluidity of the toner is lowered and the toner contact force with carriers is also lowered, thereby causing not only the charged electricity amount to decrease but also the photographic fogs to occur. Also, when the toners pass through the developing agent distributing member 8 and through between the developing rollers 61, 62, due to the poor fluidity of the toners, the stress to be applied to the developing agent becomes excessively large. During printing, since this state occurs repetitively, there occurs a spent phenomenon on the surfaces of the magnetic carriers. The spent phenomenon is a phenomenon that the toners are in part fused and adhered to the carrier surfaces. In case where such spent phenomenon occurs in a large quantity, the charged electricity characteristic of the developing agent is ill influenced, which gives rise to the occurrence of photographic fogs. In case where the stress becomes excessively large, the spent occurrence speed increases. Now, the test 8 shows a case where the coefficient SF1 deviates from the above range; and, in this case, the toner particle becomes rounded more. In this case, since the toner fluidity is good to thereby prevent the excessive stress from being applied to the developing agent distributing member 8 and to between the developing rollers 61, 62, the occurrence of the spent phenomenon can be restricted, thereby being able to improve the electricity charging characteristic and restrict the occurrence of the photographic fogs. However, since the toners remaining on the photographic body 1 after transfer are round, it is impossible to clean the toners completely by the cleaner 22. Based on these test results, the toner shape suitable for the invention can be defined in the following manner: that is, $$120 \leqq SF1 \leqq 170, \text{ preferably, } 130 \leqq SF1 \leqq 160; \text{ and,}$$

$$110 \leqq SF2 \leqq 130, \text{ preferably, } 115 \leqq SF \leqq 130.$$

According to the invention, along the moving direction of an image carrier, on the upstream side thereof, there is disposed a first developing roller movable in the opposite direction to the moving direction of the image carrier, and, on the downstream side thereof, there is disposed a second developing roller movable in the same direction as the moving direction of the image carrier; a peripheral speed ratio (S1=Vm1/Vp) between the peripheral speed (Vm1) of the first developing roller and the peripheral speed (Vp) of the image carrier is set in the range of 0.8–2.0, and a peripheral speed ratio (S2=Vm2/Vp) between the peripheral speed (Vm2) of the second developing roller and the peripheral speed (Vp) of the image carrier is set in the range of 1.05–2.0; and, as the toners of the two-component magnetic developing agent consisting mainly of toners and magnetic carriers, there are used toners in which the shape coefficient SF1 is set in the range of 120–170 and the coefficient SF2 thereof is set in the range of 110–130. Thanks to this, in a high-speed area, the life of the developing can be maintained, there can be obtained a good cleaning property, and stabilized image quality can be realized.

What is claimed is:

1. An image forming method comprising:

in a center feed developing system comprising first and second developing rollers and a developing agent distributing member formed between said first and second developing rollers, and using a two-component developing agent consisting mainly of toners and magnetic carriers:

controlling a stress applied to said developing agent between said first and second developing rollers and said developing agent distributing member, by selecting a shape coefficient SF2 of toner particles in said toners to be within a predetermined range to restrict an occurrence of photographic fog;

developing an electrostatic latent image formed on an image carrier into a toner image using said toners;

transferring said toner image onto a recording medium; and fixing said toner image transferred onto said recording medium to thereby form a recorded image on a recording sheet;

wherein said latent image is developed by said first and second developing rollers disposed along the moving direction of said image carrier and rotatable in the mutually opposite directions using said two-component developing agent consisting mainly of toners and magnetic carriers, and said toners are supplied to said latent image on said image carrier by said first and second developing rollers, wherein the moving direction of said first developing roller is opposite to the moving direction of said image carrier in a developing area, and a peripheral speed ratio (S1=Vm1/Vp) between the peripheral speed (Vm1) of said first developing roller and the peripheral speed (Vp) of said image carrier is set in the range of 0.8–2.0, wherein the moving direction of said second developing roller is the same as the moving direction of said image carrier in a developing area, and a peripheral speed ratio (S2=Vm2/Vp) between the peripheral speed (Vm2) of said second developing roller and the peripheral speed (Vp) of said image carrier is set in the range of 1.05–2.0, and wherein a plurality of shape coefficients SF1, SF2 of said toners of said two-component developing agent consisting mainly of toners and magnetic carriers are respectively defined according to the following expressions (1) and (2), $$SF1 = (\text{maximum length of diameter})^2/(\text{area of toner particle}) \times \pi/4 \times 100 \quad (1)$$

$$SF2 = (\text{peripheral length of projected image})^2/(\text{area of toner particle}) \times 100/4\pi \quad (2),$$

said shape coefficients SF1, SF2 respectively satisfying the following conditions:

$$120 \leqq SF1 \leqq 170$$

$$110 \leqq SF2 \leqq 130.$$

2. The image forming method of claim 1, wherein the peripheral speed ratio S1 is in a range from 0.9 to 1.9.

3. The image forming method of claim 2, wherein said shape coefficients SF1, SF2 respectively satisfy the following conditions:

$$130 \leqq SF1 \leqq 160$$

$$115 \leqq SF2 \leqq 130.$$

4. The image forming method of claim 1, wherein the peripheral speed ratio S2 is in a range from 1.1 to 1.9.

5. An image forming method comprising:

in a center feed developing system comprising one or more sets of first and second developing rollers and a developing agent distributing member formed between said first and second developing rollers, and using a two-component developing agent consisting mainly of toners and magnetic carriers:

controlling a stress applied to said developing agent between said first and second developing rollers and said developing agent distributing member, by selecting a shape coefficient SF2 of toner particles in said toners to be within a predetermined range to restrict an occurrence of photographic fog;

developing an electrostatic latent image formed on an image carrier into a toner image using said toners;

transferring said toner image onto a recording medium; and fixing said toner image transferred onto said recording medium to thereby form a recorded image on a recording sheet, wherein said latent image is developed by said one or more sets of first and second developing rollers disposed along the moving direction of said image carrier and rotatable in the mutually opposite directions using said two-component developing agent consisting mainly of toners and magnetic carriers, and said toners are supplied to said latent image on said image carrier by said one or more sets of first and second developing rollers, wherein the moving direction of said first developing roller is opposite to the moving direction of said image carrier in a developing area, and a peripheral speed ratio (S1=Vm1/Vp) between the peripheral speed (Vm1) of said first developing roller and the peripheral speed (Vp) of said image carrier is set in the range of 0.8–2.0, wherein the moving direction of said second developing roller is the same as the moving direction of said image carrier in a developing area, and a peripheral speed ratio (S2=Vm2/Vp) between the peripheral speed (Vm2) of said second developing roller and the peripheral speed (Vp) of said image carrier is set in the range of 1.05–2.0, and wherein the shape coefficients SF1, SF2 of said toners of said two-component developing agent consisting mainly of toners and magnetic carrier are defined according to following expressions (1) and (2), $$SF1=(\text{maximum length of diameter})^2/(\text{area of toner particle})\times\pi/4\times100 \quad (1)$$

$$SF2=(\text{peripheral length of projected image})^2/(\text{area of toner particle})\times100/4\pi \quad (2),$$

said shape coefficients SF1, SF2 respectively satisfying the following conditions:

$$120\leqq SF1\leqq170$$

$$110\leqq SF2\leqq130.$$

6. The image forming method of claim 5, wherein the peripheral speed ratio S1 is in a range from 0.9 to 1.9.

7. The image forming method of claim 5, wherein the peripheral speed ratio S2 is in a range from 1.1 to 1.9.

8. An image forming method comprising:

in a center feed developing system comprising first and second developing rollers and a developing agent distributing member formed between said first and second developing rollers, and using a two-component developing agent consisting mainly of toners and magnetic carriers:

controlling a stress applied to said developing agent between said first and second developing rollers and said developing agent distributing member, by selecting a shape coefficient SF2 of toner particles in said toners to be within a predetermined range to restrict an occurrence of photographic fog;

delivering said developing agent consisting mainly of toners and magnetic carriers to said first developing roller, said toners having a shape coefficient SF1 in a range from 120 to 170 and a shape coefficient SF2 in a range from 110 to 130;

delivering said developing agent including said toners having said shape coefficients SF1, SF2 from said first developing roller to a photosensitive body;

restricting a delivery of said developing agent including said toners having said shape coefficients SF1, SF2 from said first developing roller to said photosensitive body by using said developing agent distributing member;

scraping said developing agent including said toners having said shape coefficients SF1, SF2 from said first developing roller using a scraper;

delivering said toners supplied from a toner feed roller and said scraped developing agent onto two screw-shaped stirring members disposed in a lower portion of said developing system;

delivering said developing agent including said toners having said shape coefficients SF1, SF2 from said stirring members to said second developing roller;

delivering said developing agent including said toners having said shape coefficients SF1, SF2 from said second developing roller to said photosensitive body;

restricting a delivery of said developing agent including said toners having said shape coefficients SF1, SF2 from said second developing roller to said photosensitive body, by using said developing agent distributing member;

adjusting a supply of said developing agent including said toners having said shape coefficients SF1, SF2 delivered to said photosensitive body by adjusting a bias power source for said first and second developing rollers;

delivering a surplus of said developing agent including said toners having said shape coefficients SF1, SF2 which has been restricted by said developing agent distributing member to said stirring members using a guide plate which is adjacent to said developing agent distributing member;

forming a toner image by developing an electrostatic latent image formed on said photosensitive body, said toner image comprising said toners having said shape coefficients SF1, SF2 delivered from said first and second developing rollers;

transferring said toner image comprising said toners having said shape coefficients SF1, SF2 from said photosensitive body to a recording sheet;

fixing said toner image comprising said toners having said shape coefficients SF1, SF2 onto said recording sheet by using heat and pressure; and removing said toners having said shape coefficients SF1, SF2 which remain on said photosensitive body by using a fur brush which is in contact with said photosensitive body, wherein said first and second developing rollers are rotatable in mutually opposite directions, wherein the moving direction of said first developing roller is opposite to the moving direction of said photosensitive body in a developing area, and a peripheral speed ratio (S1=Vm1/Vp) between the peripheral speed (Vm1) of said first developing roller and the peripheral speed (Vp) of said photosensitive body is set in the range of 0.8–2.0, and wherein the moving direction of said second developing roller is the same as the moving direction of said photosensitive body in a developing area, and a peripheral speed ratio (S2=Vm2/Vp) between the peripheral speed (Vm2) of said second developing roller and the peripheral speed (Vp) of said photosensitive body is set in the range of 1.05–2.0.

9. The image forming method of claim 8, further comprising:

controlling an effectiveness of said fur brush in said center feed developing system in cleaning said toners from said photosensitive body by selecting said shape coefficient SF1 of said toners to be within said range from 120 to 170 and said shape coefficient SF2 to be within said range from 110 to 130.

10. An image forming method comprising:

in a center feed developing system comprising first and second developing rollers and a developing agent distributing member formed between said first and second developing rollers, and using a two-component developing agent consisting mainly of toners and magnetic carriers:

controlling a stress applied to said developing agent between said first and second developing rollers and said developing agent distributing member, by selecting a shape coefficient SF2 of toner particles in said toners to be within a predetermined range to restrict an occurrence of photographic fog;

developing an electrostatic latent image formed on an image carrier into a toner image using said toners;

transferring said toner image onto a recording medium; and fixing said toner image transferred onto said recording medium to thereby form a recorded image on a recording sheet;

wherein said latent image is developed by said first and second developing rollers disposed along the moving direction of said image carrier and rotatable in the mutually opposite directions using said two-component developing agent consisting mainly of toners and magnetic carriers, and said toners are supplied to said latent image on said image carrier by said first and second developing rollers, wherein the moving direction of said first developing roller is opposite to the moving direction of said image carrier in a developing area, and a peripheral speed ratio (S1=Vm1/Vp) between the peripheral speed (Vm1) of said first developing roller and the peripheral speed (Vp) of said image carrier is set in the range of 0.8–2.0, wherein the moving direction of said second developing roller is the same as the moving direction of said image carrier in a developing area, and a peripheral speed ratio (S2=Vm2/Vp) between the peripheral speed (Vm2) of said second developing roller and the peripheral speed (Vp) of said image carrier is set in the range of 1.05–2.0, and wherein a plurality of shape coefficients SF1, SF2 of said toners of said two-component developing agent consisting mainly of toners and magnetic carriers are respectively defined according to the following expressions (1) and (2), $$SF1=(\text{maximum length of diameter})^2/(\text{area of toner particle})\times\pi/4\times100 \quad (1)$$

$$SF2=(\text{peripheral length of projected image})^2/(\text{area of toner particle})\times100/4\pi \quad (2),$$

said shape coefficients SF1, SF2 respectively satisfying the following conditions:

$$130\leqq SF1\leqq160$$

$$115\leqq SF2\leqq5130.$$

* * * * *